US008692669B2

(12) United States Patent
Mayer et al.

(10) Patent No.: US 8,692,669 B2
(45) Date of Patent: Apr. 8, 2014

(54) CONSTANT OPTICAL OUTPUT ILLUMINATION SYSTEM

(75) Inventors: Tony Mayer, Burnaby (CA); Mark Vernon, Cramington (CA); Jim Ren, Richmond (CA)

(73) Assignee: Bosch Security Systems BV, Eindhoven (NL)

( * ) Notice: Subject to any disclaimer, the term of this patent is extended or adjusted under 35 U.S.C. 154(b) by 865 days.

(21) Appl. No.: 12/600,272

(22) PCT Filed: May 16, 2007

(86) PCT No.: PCT/CA2007/000879

§ 371 (c)(1), (2), (4) Date: Jun. 21, 2010

(87) PCT Pub. No.: WO2008/138097

PCT Pub. Date: Nov. 20, 2008

(65) Prior Publication Data

US 2010/0265064 A1 Oct. 21, 2010

(51) Int. Cl.
*G08B 13/00* (2006.01)

(52) U.S. Cl.
USPC ..... 340/541; 340/641; 340/815.45; 362/276

(58) Field of Classification Search
USPC ..... 340/541, 635, 641, 815.4, 815.45; 362/276, 800, 802
See application file for complete search history.

(56) References Cited

U.S. PATENT DOCUMENTS 5,783,909 A * 7/1998 Hochstein ..... 315/159
2006/0028156 A1* 2/2006 Jungwirth ..... 315/312

* cited by examiner

*Primary Examiner* — Thomas Mullen
(74) *Attorney, Agent, or Firm* — Michael Best & Friedrich LLP

(57) ABSTRACT

The present invention is an illuminator for CCTV surveillance and security applications that maintains constant optical output from an array of LEDs by employing output compensation, feedback and enhancement. This constant optical output illuminator system enables reliable long-duration low-light imaging and data capture for surveillance and security applications, via an array of LEDs, LED power supply circuitry, and output feedback and compensation circuitry in which a photodetector circuit provides a voltage signal proportional to an amount of light falling on a photosensor and the voltage signal is fed to a drive control circuit for electrical current to the LEDs to achieve a desired optical output as measured by a photosensor voltage setpoint across the photodetector circuit.

26 Claims, 12 Drawing Sheets

PRIOR ART

CONSTANT OPTICAL OUTPUT ILLUMINATION SYSTEM

RELATED APPLICATIONS

The present application is filed under 35 U.S.C. §371 from International Application PCT/CA2007/000879 filed on May 16, 2007. The entire contents of the above-identified related application are incorporated by reference herein.

FIELD OF INVENTION

This invention relates to the general field of surveillance illumination devices, particularly light emitting diode (LED) illumination devices, and power supplies for LEDs.

BACKGROUND OF THE INVENTION

Surveillance illuminator systems using arrays of LEDs mounted on metal heatsinks are widely used in the security industry to provide visible or infrared (IR) illumination for CCTV cameras, imaging or data capture devices. LED illuminators are claimed to offer lifetimes in excess of 100,000 hours, however their effective output decays from the moment the LEDs are activated. Lifetime output reductions of 20% to 50% have been quoted in manufacturer's data, and LED output is often specified at 50% of the maximum operating current at a particular ambient temperature. The need for increased illuminator range and output necessitates that LEDs be driven to their current limits in surveillance applications, a practice that reduces illuminator effectiveness, reliability, and operational lifetime.

Factors that can also degrade LED output and lifetime of surveillance illuminator systems include, but are not limited to: operation of LED arrays at fixed output currents; operation at high ambient temperatures which reduces LED efficiency (even when constant current power supplies are used); production variances in LED die quality, LED efficiency, and inefficient lensing can represent a variation of up to +/−20% in optical output power between different illuminator units.

Known prior art surveillance illumination systems utilize and may combine illuminator feedback, heat sinking, and pulse width modulation to prolong LED lifetime. However, the lifetime of even the best of these systems is still limited by their high current operation, and high temperature operation due to their use of encapsulated LEDs. Less applicable prior art uses less reliable current sensor feedback instead of direct light sensor feedback to maintain nominal illuminator output. The effective range of prior art LED illuminators can vary dramatically with temperature and time, and from unit to unit. No prior art LED illuminator system produces surveillance images of sufficiently reliable quality over the maximum operational lifetime of the monitoring equipment.

A number of patents exist which utilize photo detectors to provide feedback on optical power output for LED arrays or other light sources. At least one patent (U.S. Pat. No. 6,028,694—Schmidt) uses pulse width modulation to increase LED light output for a given heat load. A number of patents or publications seek to provide constant or 'stable' brightness or optical power, often through the feedback provided by photo detectors. Other patents seek to 'maximize' optical output from the LEDs by altering the voltage or current. A patent application that combines a limited number of the features most relevant to the present invention is LED Array Package with Internal Feedback and Control by Mazzochette, et al (US 20060012986).

SUMMARY OF THE INVENTION

This invention provides a constant optical output illuminator system to enable reliable long-duration low-light imaging and data capture. This disclosure describes an illuminator for CCTV surveillance and security applications that maintains constant optical output from an array of LEDs by employing output compensation, feedback and enhancement. The constant illuminator system overcomes a number of problems with common LED illuminators where optical output varies:

a) with temperature
b) with manufacturing tolerance
c) over time as LEDs and components in power board age
d) during initial calibration During daylight there are sources of illumination outdoors from sunlight and indoors from sunlight coming through windows as well as indoor visible light sources for work and ambience. CCTV cameras use this on-scene light to capture images, but are reliant on proper camera setup to ensure the best possible image is captured with the light available. CCTV system installation is a challenging field where the performance of a surveillance system is measured not only by the resulting image quality, but the ability to maintain that quality in all environments, lighting conditions, and during the full lifetime of the product.

At night, surveillance scenes are either without any illumination, or are artificially illuminated for human activity. Both of these night-time scenarios are far from optimal when the quality of CCTV images for security and surveillance applications is considered.

Previous pioneering work in illuminators has resulted in widespread use of infrared (IR) illumination in conjunction and support of CCTV systems for surveillance and security. For example, the patented illuminator sold as the UF500 (TM of Extreme CCTV International Inc.) provides a usable night-time CCTV image that does not rely on ambient lighting on scene. As the industry matures however, higher demands are placed on the CCTV infrastructure including the use of advanced video analytics software to monitor video from CCTV cameras.

The demand for improved night-time performance has led to LED illuminators with Black Diamond (TM of Extreme CCTV International Inc.) patent-pending illuminators that use micro-diffractive refractive elements which channel light from the LEDs so as to alter the distribution of illumination on the target and/or to make illumination more efficient by conserving light. (See FIGS. 2 & 4) The Black Diamond technology provides far more even and efficient distribution of optical energy from a micro-diffracted illuminator (see FIG. 15) than traditional LED illuminators (see FIG. 14).

To further evolve security and surveillance illumination performance Extreme CCTV has created a family of CCTV illuminators that maintain constant optical power output over time and across varying environmental conditions for the life of the product. Maintaining even illumination for the life of the product ensures the quality of the image from the CCTV system will be as good as the day it was installed.

It is common for illuminator products to be quoted as having a lifetime of between 3 years and 10 years. Depending on the quality of the manufactured product, and assuming no catastrophic failures, the illumination power on scene will degrade over time. Typical illuminator lifetime quoted from manufacturers is stated from 80% to as low as 50% of rated output. The rate of drop of optical output from LED illuminators is directly related to the internal operating temperature of the LED itself.

The combined effects of manufacturing variance, temperature variation and lifetime degradation are additive, making a worst case variation in the region of +/−50% optical output power under various conditions. The constant illuminator system 20 will guarantee 100% constant optical power over the same conditions giving confidence in security system design.

By monitoring and maintaining optical power output from the illuminator, the quality of the CCTV image will not change over time and will therefore greatly enhance the image quality as well as extend the useful life of the security/surveillance system.

The constant illuminator system is designed to provide reliable long-duration illumination for low-light imaging and data capture. By packing higher power LEDs closer together and running them with less current, then making more efficient use of their light output by focusing through a lens, then an asymmetric diffuser, the resultant light output is at least equal to the prior art, but provides constant illumination over a much longer operational lifetime. Photodetectors also monitor total LED output and increase drive current or activate additional auxiliary LEDs to maintain optimal LED output longer than other solutions. Overheating is prevented by lowered operating current, pulse width modulation and by use of efficient heatsinking. The constant illumination system may use surface mount or through-hole LEDs in either visible or infrared wavelengths, depending on the surrounding light available and monitoring equipment used.

To summarize, the invention provides a constant optical output illuminator system to enable reliable long-duration low-light imaging and data capture for surveillance and security applications, comprising an array of LEDs, LED power supply circuitry, and output feedback and compensation circuitry, in which a photodetector circuit provides a voltage signal proportional to an amount of light falling on a photosensor and the voltage signal is fed to a drive control circuit for electrical current to the LEDs, to achieve a desired optical output as measured by a photosensor voltage setpoint across the photodetector circuit. It also provides the innovation of a constant optical output illuminator system to enable reliable long-duration low-light imaging and data capture for surveillance and security applications, comprising an array of LEDs, LED power supply circuitry, and output feedback and compensation circuitry, in which optical output from the LEDs is controlled based on feedback from at least one photodetector that is embedded in the array of LEDs.

More detailed innovative embodiments of the invention include such systems in which:

a) the voltage setpoint is adjustable via potentiometer for manual control, or the voltage setpoint is adjustable via microcontroller for dynamic control and remote control;

b) optical output from the LEDs is controlled via current control based on feedback from a plurality of photodetectors is embedded in the array of LEDs, each photodetector sending a light output feedback signal for current control of the optical output from the LEDs and via pulse modulation based on feedback from one or more photodetectors embedded in the array of LEDs;

c) a microcontroller receives feedback from the photodetectors and uses that feedback to control electrical current to the LEDs via pulse modulation;

d) the array of LEDs is surface-mounted on an insulated metal substrate material;

e) the array of LEDs uses infrared wavelengths that are not substantially visible to a human eye but are visible to IR sensitive CCD and CMOS cameras;

f) the LEDs are compacted closely together and are lensed, not limited to being lensed with tessellated hexagonal lenses;

g) the photodetectors are spread throughout the LED array so as to obtain substantially average measurements of light output;

h) a microcontroller determines maximum allowable current drive for the LEDs;

i) a bandpass filter is used on each photodetector sensors and the bandpass filter corresponds to light output wavelength of the LEDs;

j) a step pass filter is used to pass substantially all of light output wavelength of the LEDs to each photodetector;

k) the photodetectors are oriented within the LED array so as to capture light from the LEDs rather than external ambient light;

l) a microcontroller monitors junction temperature and ensures it does not exceed a predetermined maximum level;

m) a microcontroller triggers an alarm when the LEDs decay beyond a predetermined level;

n) feedback and compensation circuitry adjusts optical output from the LEDs to compensate for the optical output varying with ambient and system temperature and with aging of the LEDs and power board components;

o) the control circuitry compensates for input voltage variations, temperature which affects both the control circuit as well as LED output, component tolerances in the drive circuit, and LED panels as well as performance degradation of the power components and LEDs.

DETAILED DESCRIPTION

Figure 1:
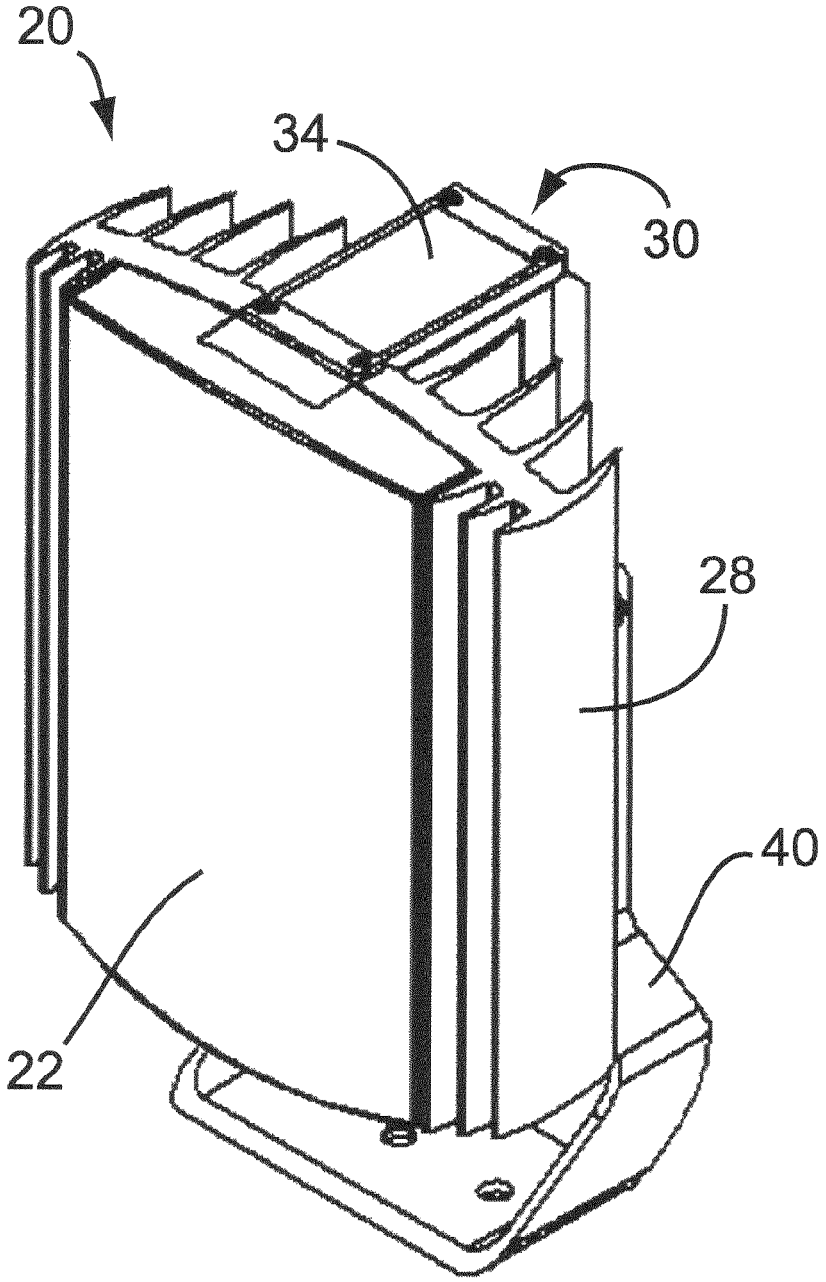
FIG. 1. is an isometric exterior view of the constant illuminator system.

FIG. 1 shows the exterior of a constant illuminator system 20, with its faceplate 22, heatsink 28, mounting bracket 40, LRB (LED Regulator/Control Board) enclosure 30, and its top coverplate 34.

Figure 2:
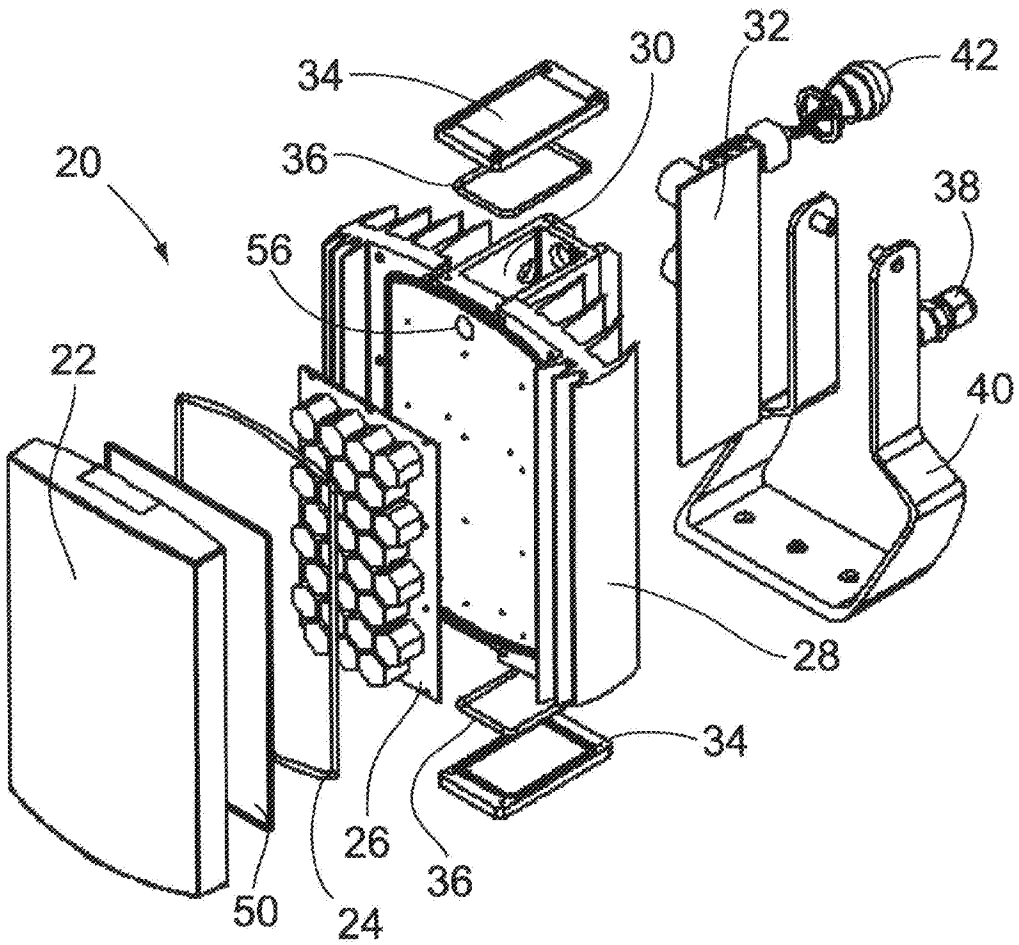
FIG. 2. is an isometric exploded view of the constant illuminator system.

FIG. 2 shows an exploded view of the constant illuminator system 20, with its faceplate 22, micro-diffractor 50, faceplate gasket 24, and LED array board 26. The heatsink 28 and LRB enclosure 30 are cast as one unit, but are defined as separate functional elements. The elements listed above are assembled onto the front of the heatsink 28. Any heated gas or moisture from the LED array board 26 escapes through the internal wall of the heatsink 28, into the LRB enclosure 30. Pressure and moisture are then passed out of the LRB enclosure 30 by means of a pressure relief valve 38. The LRB enclosure 30 houses an LED regulator/control board (LRB) 32, sealed from external environments by means of a coverplate 34 and a gasket 36 with fasteners 52 (shown in FIG. 4). Attached to the LRB 32, is an ambient photocell assembly 42, which fits through a hole through the rear wall of the LRB enclosure 30, and is sealed from external environments. The LRB 32 electrically attaches to the LED array board 26 by means of a connector 56 passing through the inner wall of the heatsink 28. A mounting bracket 40 is shown, which attaches by means of mounting bolts 54 to the sides of the LRB enclosure 30 (shown in FIGS. 4 & 5).

Figure 3:
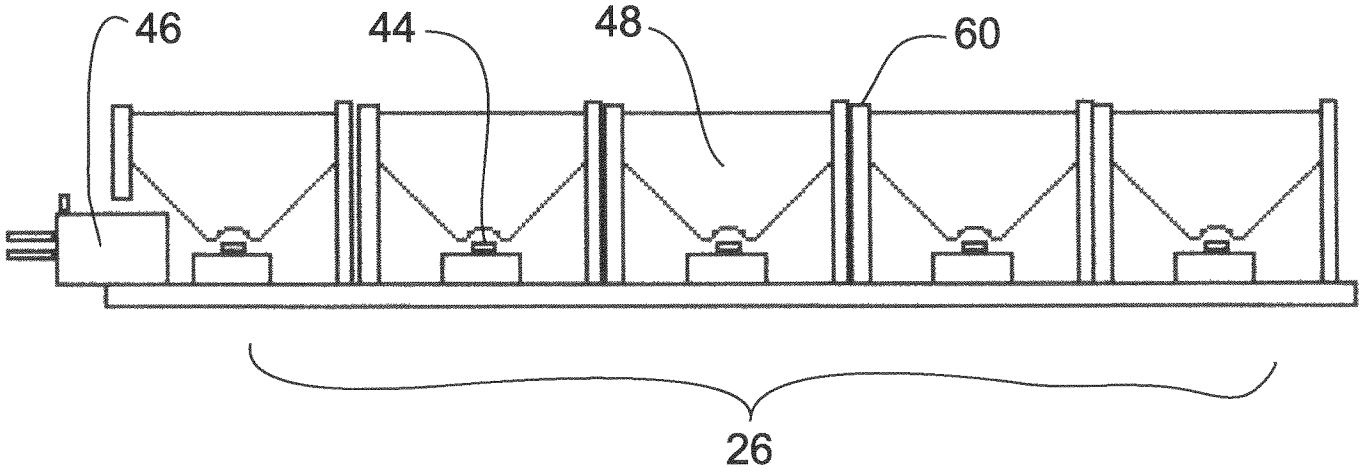
FIG. 3. is a side view of LED array board with feedback sensor.

FIG. 3 shows a side view of the LED array board 26 with its light emitting diodes (LEDs) 44, which are each covered by a lens-like focuser 48, which are surrounded by an opaque housing 60, and whose output is monitored by a multiplicity of photocells 46.

Figure 4:
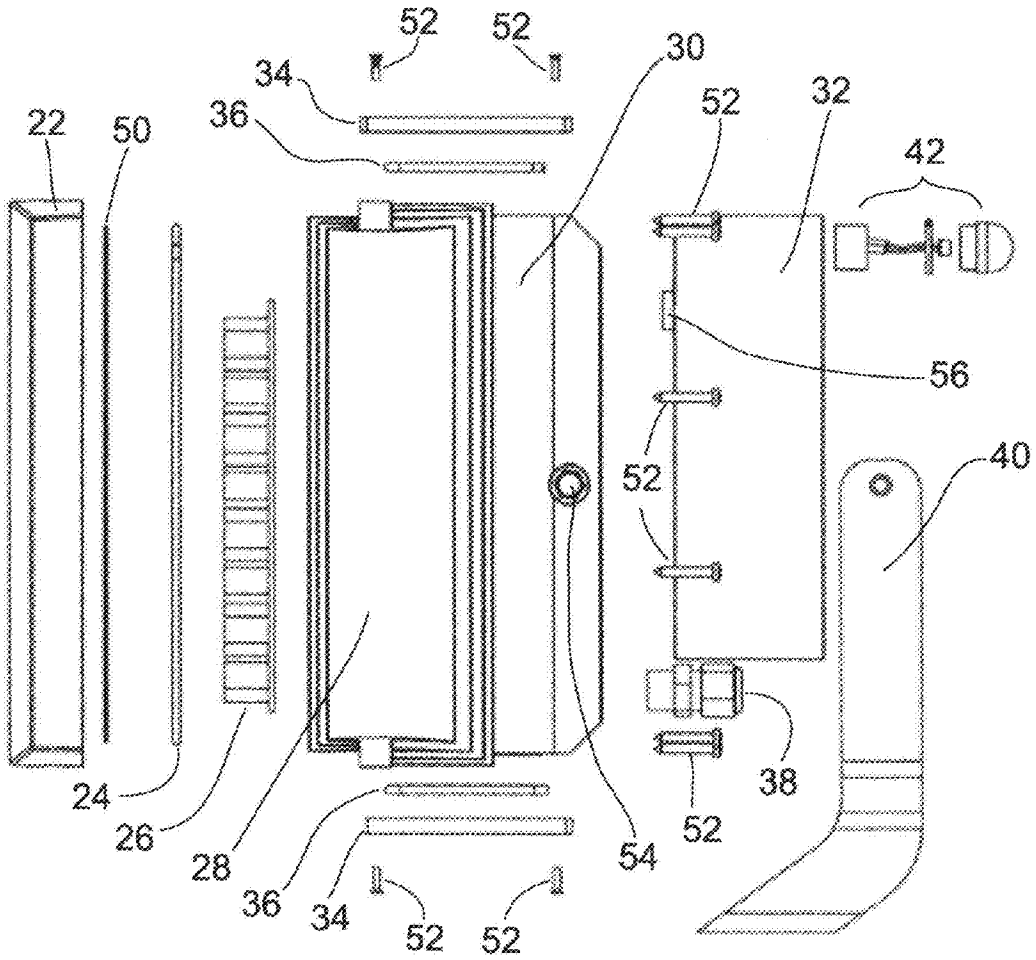
FIG. 4. is a side exploded view of the constant illuminator system.

FIG. 4 shows a side view of the same elements of the constant illuminator system 20 shown in FIG. 2, but also includes the fasteners 52 required to seal the unit from external environments, secure internal components and the mount the bracket.

Figure 5:
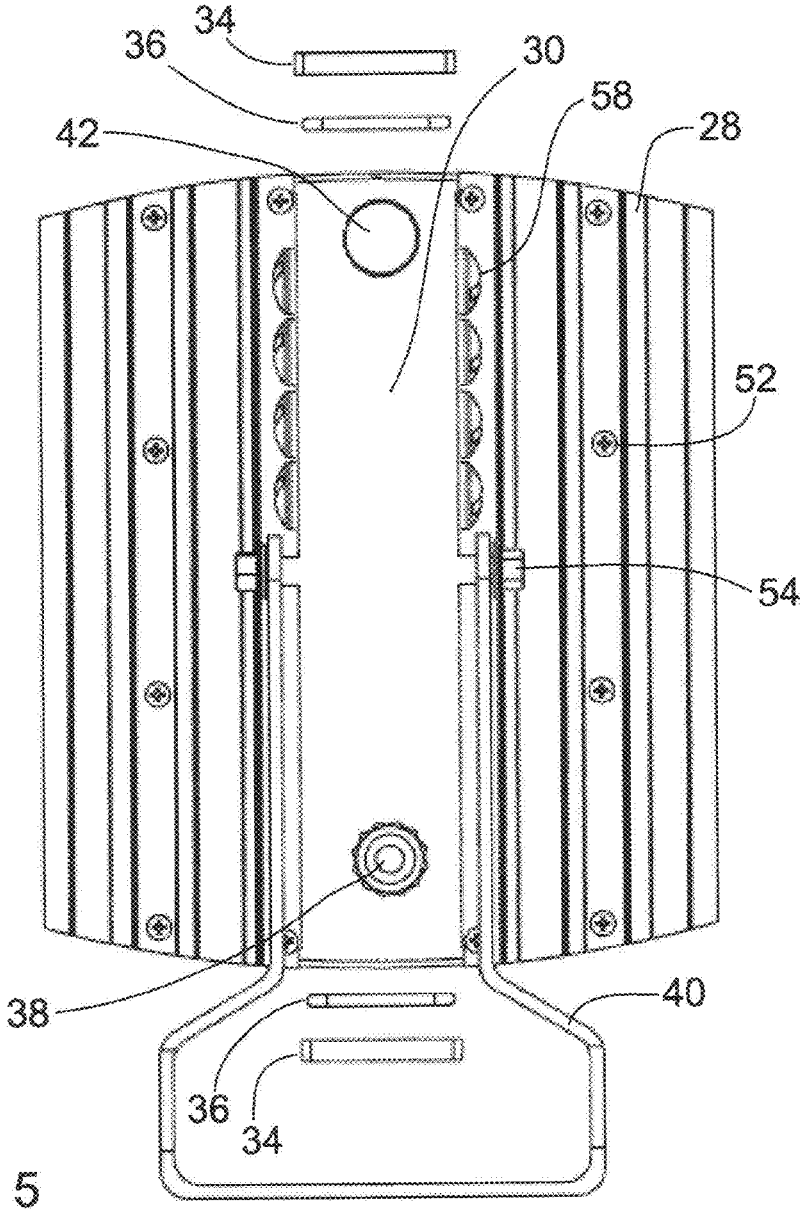
FIG. 5. is a rear view of the constant illuminator system.

FIG. 5 shows a rear view of the constant illuminator system 20, with its mounting bracket 40 and mounting bolts 54 attached to sides of the LRB enclosure 30, which is sealed by means of a coverplate 34 and coverplate gasket 36 at top and bottom. Shown passing through the rear wall of the LRB enclosure 30 while maintaining enclosure integrity is the ambient photocell assembly, and the pressure relief valve 38. External components are connected through enclosed conduits (not shown) to the LRB 32 through threaded holes in the side walls of LRB enclosure 30, which are sealed when not used by means of a gasketed conduit plug 58. Fasteners 52 are also shown passing through the heatsink 28, which are used to secure components on its other side.

Figure 6:
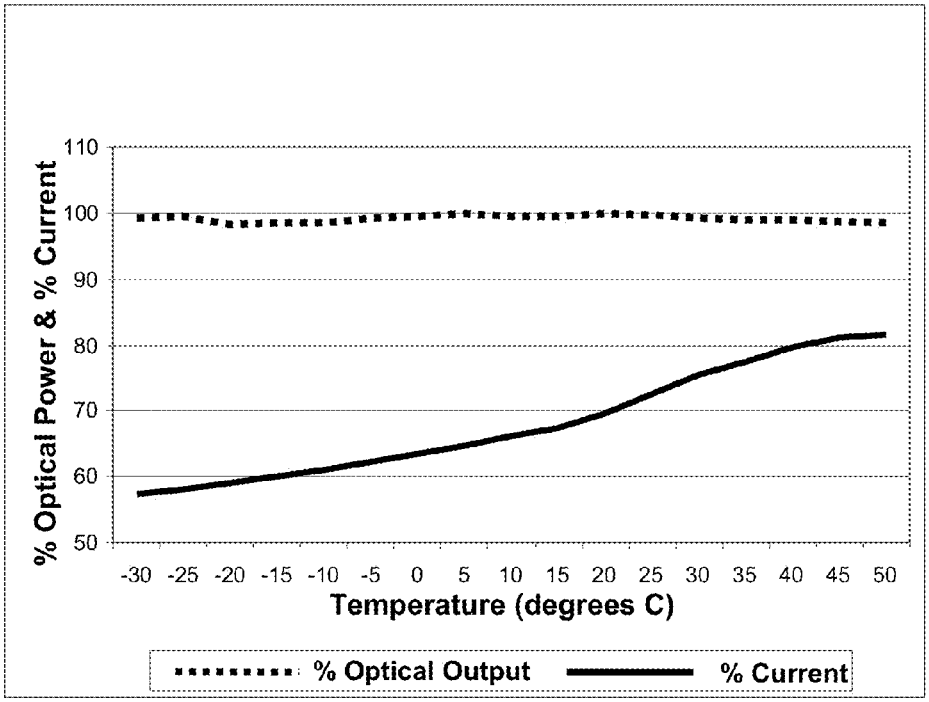
FIG. 6. is a graph showing constant illuminator output maintained across a wide temperature range by varying current.

FIG. 6 shows the constant illuminator system 20 maintaining a constant optical power output (+/−1%) over a wide temperature range by varying the LED array board 26 current. The output current never reaches 100%, but does rise over the lifetime of the LEDs 44 by compensating for LED 44 degradation over time as well as temperature.

Figure 7:
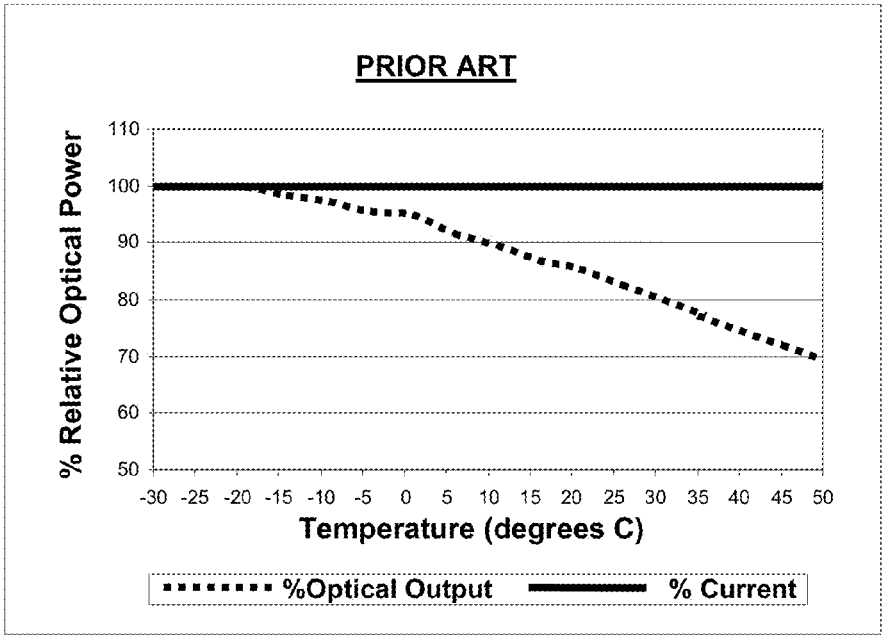
FIG. 7. is a graph showing prior art illuminator output reduction at higher temperature.

FIG. 7 shows the corresponding graph for a conventional uncompensated illuminator running in a constant current feedback loop. Here we can see that even with constant current, the optical output of the standard illuminator changes dramatically with temperature.

Figure 8:
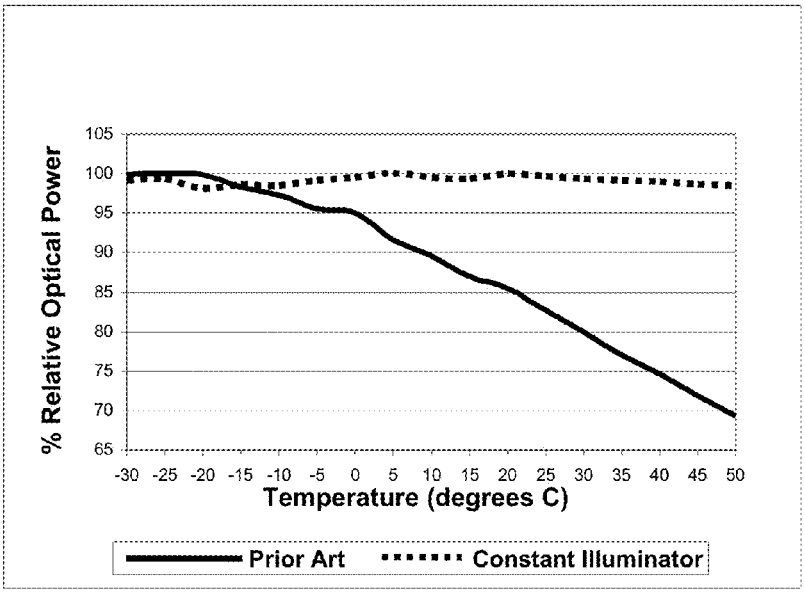
FIG. 8. Is a graph comparing constant illuminator output with prior art across a wide temperature range.

FIG. 8 compares the optical output of prior art illuminators and the constant illuminator system 20 over the operational temperature range.

Figure 9:
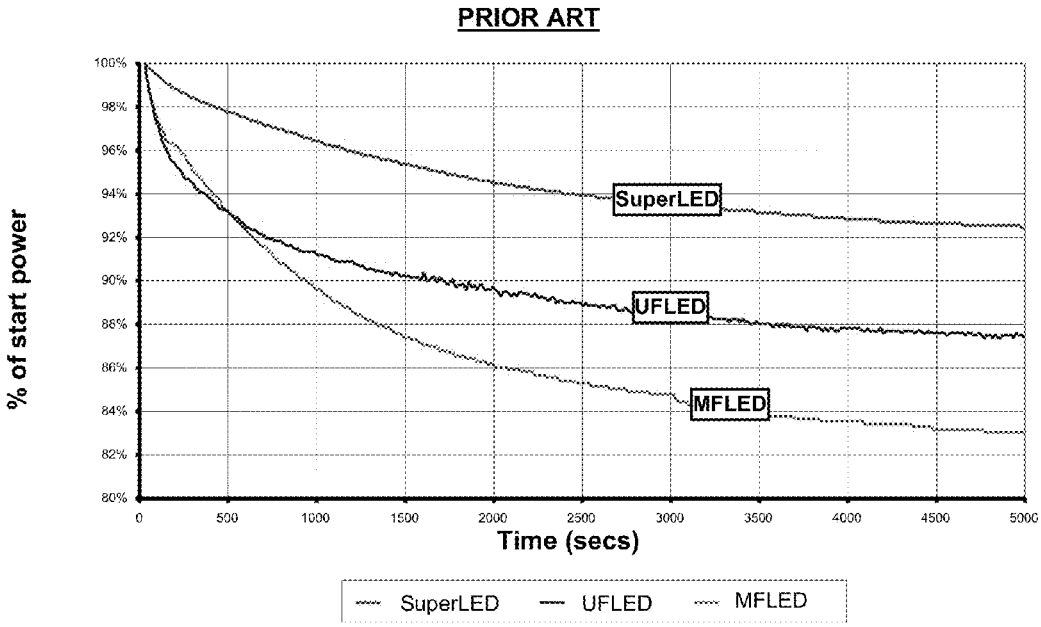
FIG. 9. is a graph showing prior art output degradation during warm-up.

FIG. 9 shows that from initial power up there is degradation of power output for various LEDs used in conventional illuminators. This warm up period can last up to 1.5 hrs. During testing, calibrating and commissioning this output degradation can give misleading results if uncompensated.

Figure 10:
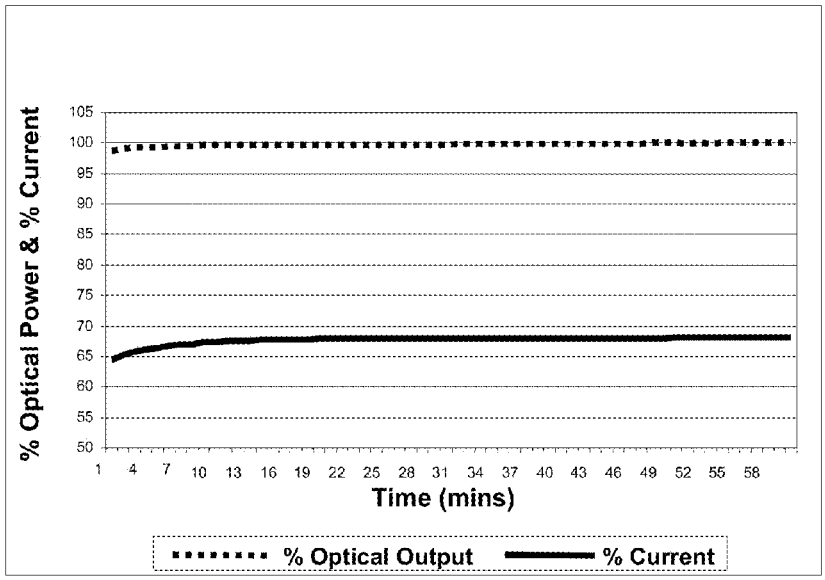
FIG. 10. is a graph showing constant illuminator output during warm-up and lowered current requirements.

FIG. 10 shows that there is effectively no start up delay in the output for the constant illuminator system 20, which reaches 99% of its specified output within 1 minute, at 18 degrees Celsius. The operating current is lower at the initial startup because the units are more efficient when they are not overheating.

Figure 11:
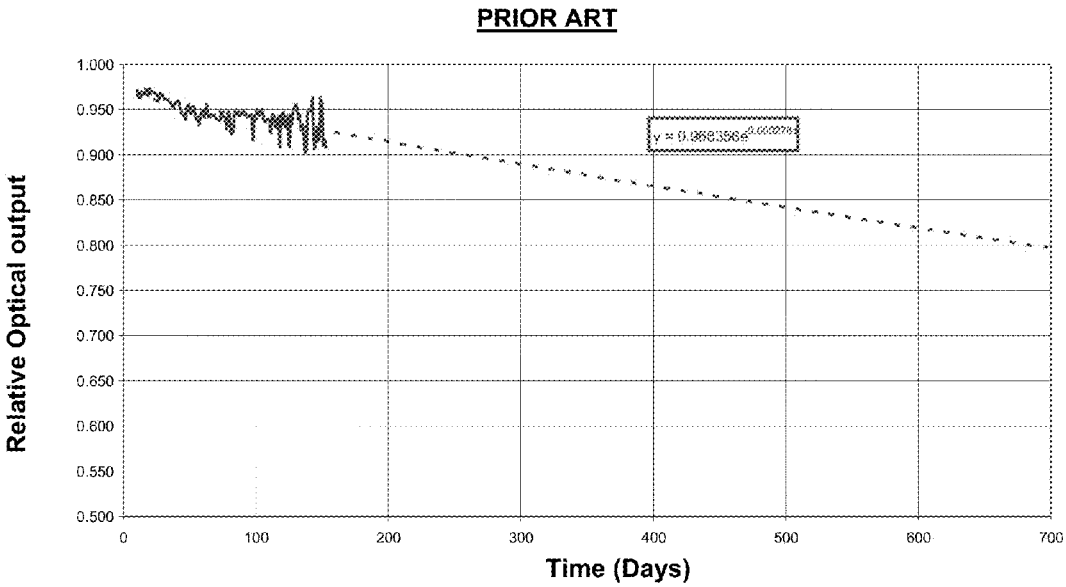
FIG. 11. is a graph of extrapolated plot of prior art illuminator output degradation.

FIG. 11 shows an extrapolated plot of relative optical power output versus time for an uncompensated illuminator, with ambient temperature corrected to 28 degrees Celsius. Note that this extrapolation assumes continuous operation of the illuminator. Operational lifetime would be extended by an approximate factor of 3 due to 8 hrs/day of operation, on average throughout the year. This means that a 20% reduction would occur in 2 years of continuous use and in normal use this would take 6 years. The constant illuminator system 20 is designed to maintain its 100% output for a similar period of time at which point it will start to degrade in a manner similar to standard illuminators, but at a greater rate of decay, all things being equal.

Figure 12:
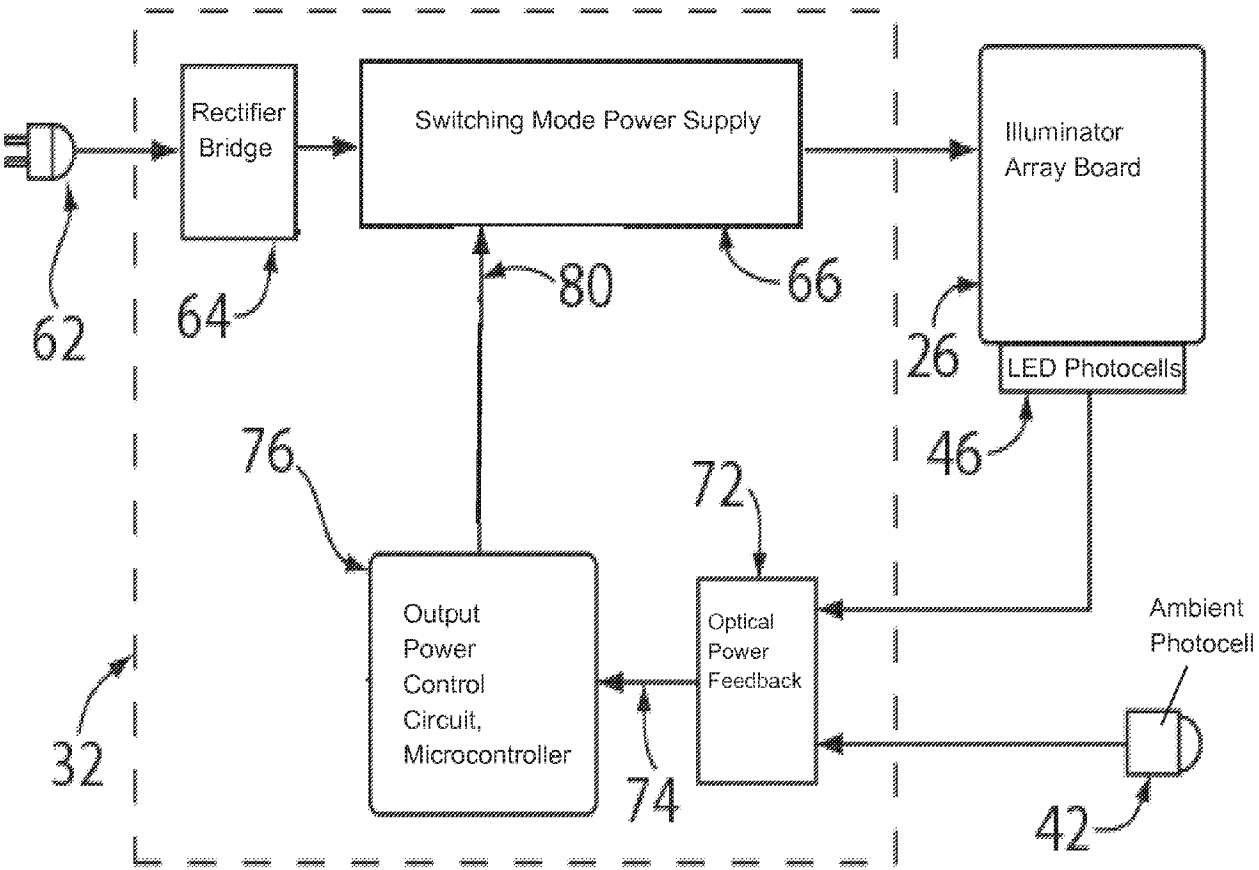
FIG. 12. is a block diagram outlining the functional elements of the LED regulator/control board (LRB).

FIG. 12 shows a block diagram illustrating the basic elements of the electronic operation of the constant illuminator system 20. AC/DC input 62 supplies electrical power to a rectifier bridge 64 and thence to a switching mode power supply 66 that drives LED output from the illuminator array board 26 and LED photocells 46. Optical power feedback 72 is received from the array board 26 and LED photocells 46, and also from the ambient photocell 42 (these elements being an example of a photodetector circuit), and sends an electrical voltage feedback signal 74 to the output power control circuit 76. The output power control circuit 76 is a kind of LED drive control. It would contain a microcontroller, as shown in the more specific schematic of FIG. 13. The output power control circuit 76 in turn sends a signal 80 to the switching mode power supply 66 to adjust its output accordingly. The output power control circuit 76, rectifier 64, and switching mode power supply 66 (together the LED power supply circuitry) can be mounted on an LED regulator control board (LRB) 32. The arrangement shown in FIG. 12 is an example of feedback and compensation circuitry. The basic arrangement of FIG. 12 can be implemented as in the very detailed schematic of FIG. 13, including enhancements such as a potentiometer for manual voltage setpoint adjustment and alarm circuitry for maximum power thresholds being exceeded.

Figure 13:
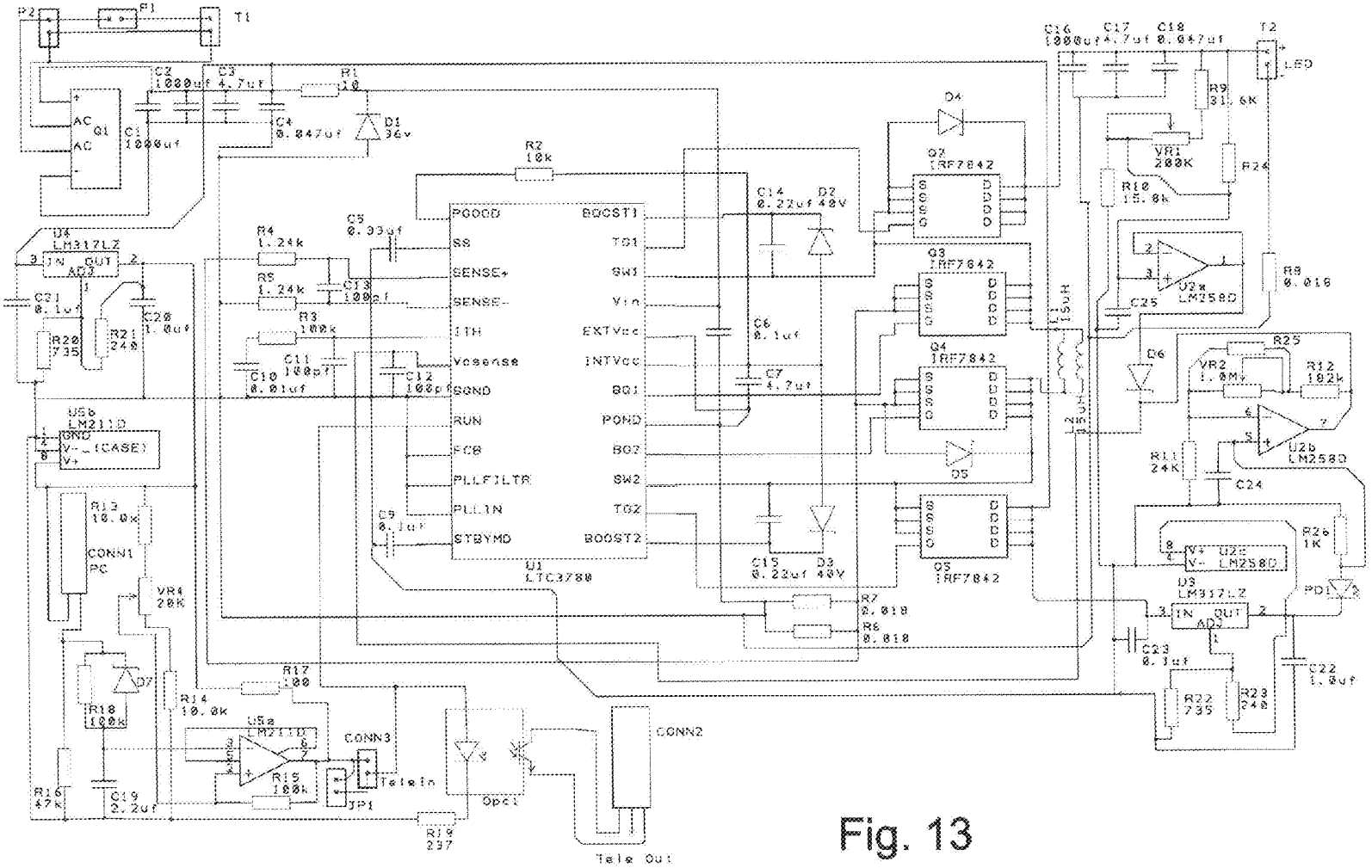
FIG. 13. is a schematic of LED regulator/control board (LRB) electronics.

FIG. 13 shows a schematic diagram of electronic components used in the operation of constant illuminator system 20.

Figure 14:
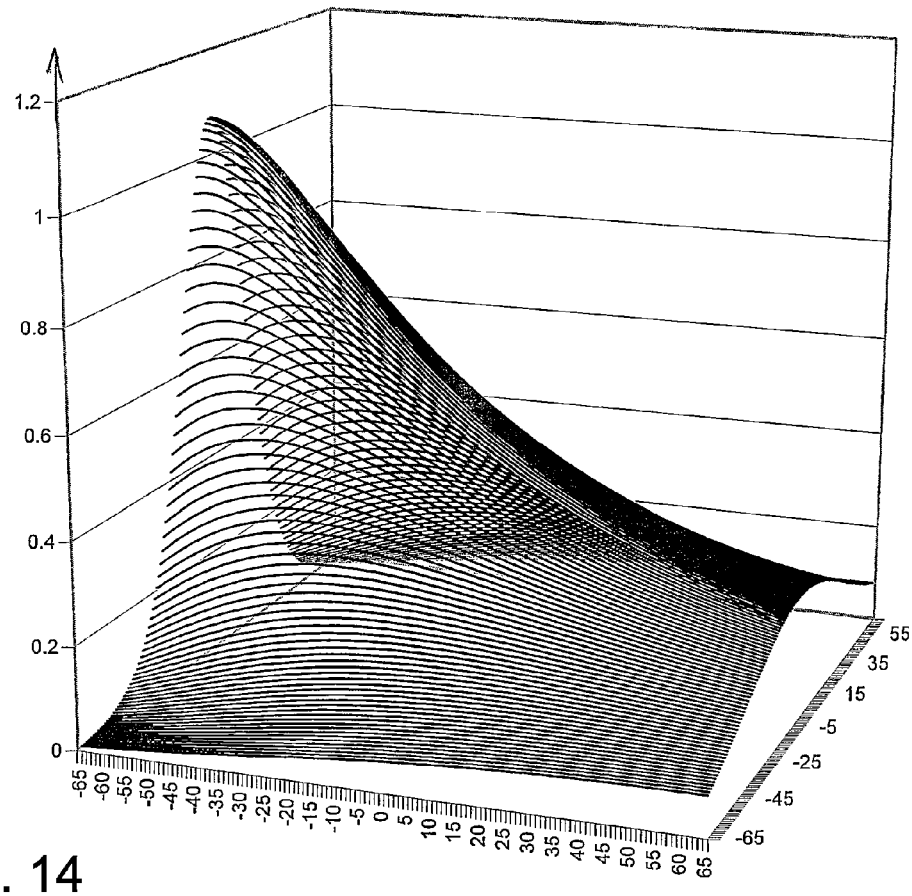
FIG. 14. is a graph showing area power output of prior art illuminators.

FIG. 14 shows an area plot of optical power output of a conventional LED illuminator array, in microwatts per square centimeter.

Figure 15:
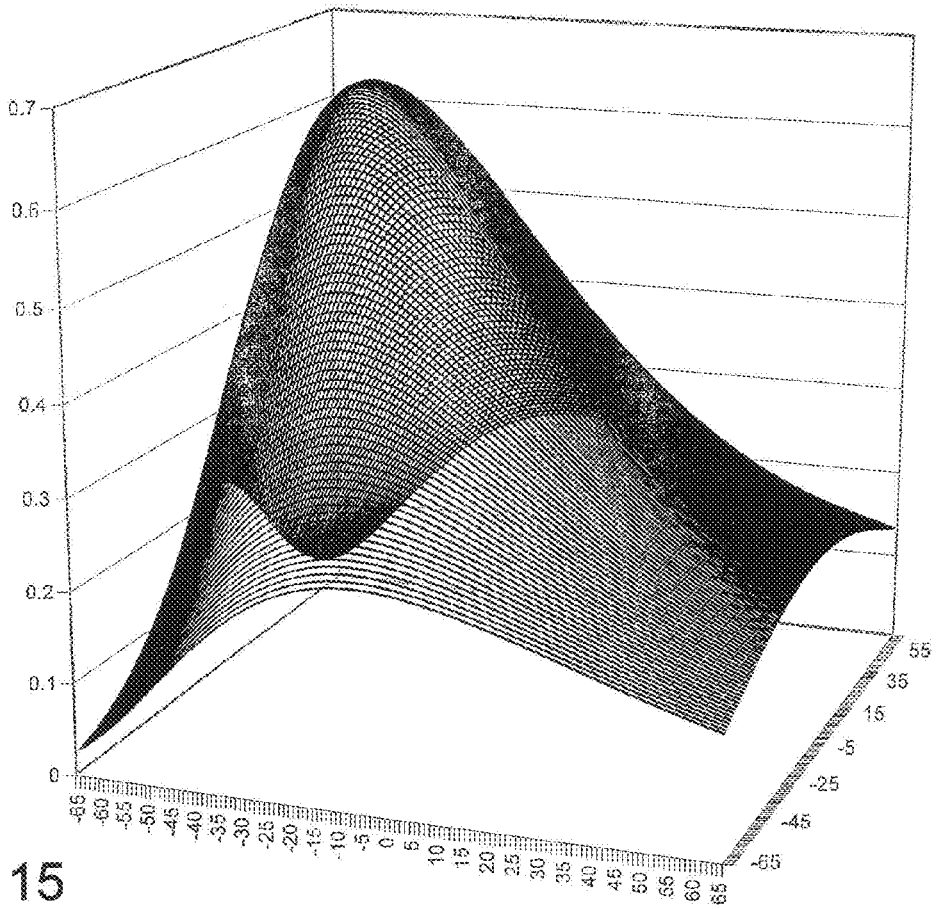
FIG. 15. is a graph showing area power output of the constant illuminator using asymmetric diffusion.

FIG. 15 shows an area plot of optical power output of the constant illuminator system 20, in microwatts per square centimeter.

A preferred embodiment of the constant illuminator system will now be described in detail.

A. LED Array Board: The LED array board 26 houses an array of light emitting diodes (LEDs) 44, each of which is capped by a focuser 48, which is registration-mounted to the board 26. Most LEDs spray light in all directions, which is an inefficient use of power and light. The focuser 48 is a plastic hexagonal tessellated lens which focuses the light from each LED 44 into a tight cylindrical pattern.

B. LED Photocell: The LED photocell 46 is a photon sensing device such as photodetector, photodiode or phototransistor which is placed in the illumination cavity, connected in place of a current sensing resistor on the LRB 32 to provide direct control of current to LED array 26 based on voltage across the photodetector. The LED photocell 46 may include a filter to block extraneous wavelengths of light, enabling both daytime use, and to prevent intentional interference with the operation of the illuminator 20. This filter may be a step pass filter restricting the LED photocell 46 to a specific part of the light spectrum or notch type filter that further restricts the sensitivity of the LED photocell 46 to a narrow region that corresponds to the spectral output of the LED array 26. FIG. 3 shows the arrangement of the LED photocell 46 at 90 degrees to the direction of the LED 44 output. This particular arrangement is such that the opaque plastic housing 60 of the focuser 48 shields the LED photocell 46 from stray light that could be reflected back into the board, which could provide inaccurate output feedback data to the LRB 32.

C. Ambient Photocell Assembly: The ambient photocell assembly 42 is an external photocell used to measure ambient light, and is shown in FIGS. 2, 4, & 5. By means of its associated hardware, the photocell 42 is connected to the LRB 32 through the rear wall of the LRB enclosure 30. The function of the ambient photocell assembly 42 is to supply the ambient light level to the LRB 32 which then determines when the LED array board 26 should turn on by comparing the light level with a predetermined setpoint.

D. Faceplate & Gasket: The faceplate 22 protects the LED array board 26, and when fastened properly, the faceplate gasket 24 allows IP68-rated submersion protection. In some implementations the faceplate 22 blocks visible light, but passes infrared light in order to prevent inaccurate LED photocell 46 feedback data. In these implementations, a step pass filter serves to reduce ambient light to/from the source.

E. Micro-diffractor: Asymmetric diffusion of the focused output from the LED array 26 occurs by means of a sheet of micro-diffractor material affixed to the inside of the illuminator faceplate 22. (see FIGS. 2 & 4) Current implementation of micro-diffractive material is by means of pressure sensitive adhesive, but other techniques could be used offering the same results. Micro-diffractive material spreads and focuses light from the LED array 26 onto the imaged target in a pattern with greater efficiency than prior art. (compare FIGS. 14 & 15)

F. Physical Layout: The heatsink 28 and LRB enclosure 30 are formed as a single unit out of 6063 aircraft aluminum. The chamber in which the LED array 26 is housed shares the same environment and pressure as that of the LRB enclosure 30. Top and bottom coverplates 34 with their gaskets 36 are used to seal the LRB 32 into the LRB enclosure 30 by means of fasteners 52. In order to allow external electrical connections, threaded holes are available on the sides of the LRB enclosure 30, which are sealed when not used by plastic gasketed conduit plugs 58. Incorporating the LED regulator/control board (LRB) 32 into the Illuminator 20 itself provides added performance and cost benefit by reducing the signal loss from the LED photocell 46 feedback.

G. Pressure Relief Valve: Pressure is equalized to the outside ambient via the pressure relief valve 38. The pressure relief valve 38 is simply there to prevent pressure buildup when the LED array 26 or LRB 32 heats the enclosed air during operation of the illuminator 20. These units are IP68 rated, meaning they can withstand submersion—so they are effectively sealed from external environments. The problem with a sealed environment is Boyle's law where the contained gas expands as the Illuminator gets hot which pushes out the frontplate. This has undesirable aesthetic impact and may affect the actual performance of the product as well. The pressure relief valve 38 allows the internal and external pressures to equalize and lets moisture escape but will not admit moisture into the LRB enclosure 30. The pressure relief valve 38 functions very much like the semipermeable membrane shell of an outdoor jacket that allows the wearer to vent heat and moisture but does not allow moisture back in.

H. LED Regulator/Control Board (LRB): The LRB 32 is the current output regulator and control board used to drive and maintain the LED array board 26. Refer to FIG. 12—LRB Block Diagram for an overview of the LRB 32, and FIG. 13—Schematic for component details. The LRB 32 has both maximum current and maximum voltage limiting to prevent the LED array 26 from operating beyond the current & heating ratings of its LEDs 44. Controller features include: variable power output, passive IR triggering, and a timed profile where a specific power profile can be used. For example high power is used for 1 second and low power is used for 5 seconds, or high power is used for 1/15 second to illuminate for two video frames and off for remaining 14/15 second to save power. Adjustment and Calibration features include: high voltage limiting, high current limiting, measurement points for operating and maximum voltage and current. The LRB 32 controls and drives the LED array 26 by means of a connector 56 through the heatsink 28 wall.

I. Constant Illuminator Power Output: The power output from typical switch mode power supplies includes buck, buck/boost, and boost topologies which vary with input voltage as well as temperature. Typical designs rely on a sensing resistor to provide feedback for the amount of current or voltage being supplied to the LED array 26. FIG. 13 shows a transimpedance amplifier used to convert the photoinduced current of the LED photocell 46 to an amplified output voltage, which determines how much current is supplied to the LED array 26.

CCTV imaging used for security and surveillance applications relies on light to capture images of the area of interest. As Ansel Adams said 'if there is no light, there can be no picture'. The constant illuminator system 20 is particularly useful when combined with Extreme's patent pending Black Diamond (micro-diffraction) Illumination technology that provides even illumination for CCTV imaging over a 3 dimensional area.

Use of surface mount technology also allows operating conditions to be set to the highest output levels expected on a standard product i.e. the output expected at −30 degrees at the start of life before warm up, and maintain this level to beyond the warranty period of 5 years.

The object of the constant illuminator system 20 is to guarantee a constant optical power output for a specified minimum period of time, over a specified range of temperature, by producing constant illumination from an optimal number of individual LEDs 44, and which results in a constant illuminator range and image quality performance.

To achieve the above stated object, LED array boards 26 must have a higher output power density over a longer duration than the prior art. The first step of this object can be achieved by using higher power surface mount technology (SMT) LEDs 44 densely mounted on insulated metal substrate circuit boards 26. However, when using high power LEDs 44 in an industry standard size illuminator, the heatsink 28 cannot remove enough heat to maintain the LED 44 junction temperature below its critical breakdown value. If the number of LEDs 44 is maximised to the available space, no advantage can be gained over using half the number of LEDs 44, because heat cannot be removed quickly enough in a static system. For this reason, prior art solutions spread fewer LEDs 44 over a wider heatsink 28 area and use large circular lenses to narrow the output.

The constant illuminator system 20 uses an array of high power LEDs 44 on insulated metal substrate material 26, where LEDs 44 are compacted closely together and whose output uses tessellated hexagonal lenses as focusers 48. The number of LEDs 44 is then maximised or significantly increased above the number of LEDs 44 that would normally constitute the maximum based on thermal limitations. The LED array board 26 is run at a lower operating current so as to give the same equivalent power output as that expected from the standard solution. A number of LED photocells 46 monitor the actual array 26 output, which is then applied to vary the drive current of the LEDs 44 to maintain constant optical power output. Additional backup LEDs 44 are mounted on the LED array board 26, which may be activated to compensate for the decay in total array 26 output power over time, and thereby maintain constant illumination.

To obtain output feedback, a number of photo detectors, known as LED photocells 46, are placed within the LED array board, in the vicinity of the LEDs 44, as shown in FIG. 3. A multiplicity of LED photocells 46 are spread across the array 26 to obtain an average illumination inside the front cavity of the illuminator. Using only a single feedback sensor 46 would give an inaccurate output reading because it would be responding to too small a sample of the entire LED array 26. LED photocells 46 should ideally be bandpass filtered to correspond to the wavelength of the illuminator LEDs, thus reducing the potential for skewing feedback from external light sources. For this reason, LED photocells 46 should point 90 degrees from the illuminator output LEDs 44, looking at the scattered light inside the illuminator, as is shown in FIG. 3.

Another step towards fulfilling the object of constant illumination is to use a power supply topology that accepts pulse-width modulation (PWM) input to control the average current through the LED array 26 as governed by feedback from the LED Photocells 46. (see FIG. 13) A small microcontroller can also be used to add additional safety features like maximum allowable current drive and maximum junction temperature monitoring to extend LED array 26 lifetime.

Inevitably there comes a point where the decay of the LEDs 44 can no longer be compensated for, and this point can effectively be designed to occur after a certain minimum number of hours. At this point an alarm output could be triggered to warn that the LEDs 44 are starting to decay beyond the performance specifications of the illuminator 20.

There are currently no known commercial illuminators in the CCTV industry or general lighting industry that use LED photocell 46 feedback to maintain constant optical power output.

The constant illuminator system maintains constant optical power from a dense configuration of LEDs by utilizing pulse modulation technology and heat sink technology in conjunction with advanced features such as a sophisticated microcontroller and photo detectors.

Other embodiments of the constant illuminator 20 are described below. Other embodiments are not ruled out or similar methods leading to the same result.

The frontplate may block visible light for use with IR LED illuminator applications—but the constant illuminator 20 may be used for visible LED illuminator applications which would require frontplate material that passes visible wavelengths of light, such as clear or translucent plastic.

The constant illuminator system 20 may use infrared LEDs emitting wavelengths of 730 nm, 808 nm, 850 nm, 880 nm or 940 nms (nanometers); as well as visible spectrum LEDs including blue, green, red, amber and white. LEDs 44 may be either plated through hole or surface mount and may be low power or high specific output type LEDs.

The constant illuminator system 20 may use infrared LEDs emitting wavelengths of 730 nm, 808 nm, 850 nm, 880 nm or 940 nms (nanometers); as well as visible spectrum LEDs including blue, green, red, amber and white. LEDs 44 may be either plated through-hole or surface mount and may be low power or high specific output type LEDs.

The invention claimed is:

1. A constant optical output illuminator system to enable reliable, long-duration, low-light imaging and data capture for surveillance and security applications, comprising an array of LEDs, LED power supply circuitry, and output feedback and compensation circuitry, in which:

a) a photodetector circuit provides a voltage signal proportional to an amount of light falling on at least one photosensor and the voltage signal is fed to a drive control circuit that supplies electrical current to the LEDs, to achieve a desired level of optical output commensurate to a voltage setpoint of the photosensor in the photodetector circuit; and b) the output feedback and compensation circuitry adjusts the optical output from the LEDs to compensate for voltage variations in the current supplied to the LEDs, for temperature variations that affect the optical output of the LEDs, for component tolerances in the power supply circuitry and in the LEDs, and performance degradation of the LED power supply circuitry and of the LEDs.

2. The constant optical output illuminator system of claim 1, in which the voltage setpoint is manually adjustable.

3. The constant optical output illuminator system of claim 2, wherein the at least one photosensor comprises a plurality of photosensors, which are mounted among the LEDs and provide feedback regarding light output from the LEDs and detected by the plurality of photosensors enabling the photodetector circuit to obtain substantially average measurement values of the light output from the LEDs.

4. The constant optical output illuminator system of claim 2, wherein the at least one photosensor comprises a plurality of photosensors, which are in the photodetector circuit and are oriented toward the LEDs within the LED array so as to capture light from the LEDs rather than external ambient light.

5. The constant optical output illuminator system of claim 1, in which the voltage setpoint is automatically adjustable via a microcontroller.

6. The constant optical output illuminator system of claim 5, wherein the at least one photosensor comprises a plurality of photosensors, and:

a) optical output from the LEDs is controlled by the output feedback and compensation circuitry via a quantity of electrical current that is sent to the LEDs based on feedback from the plurality of photosensors mounted among the LEDs regarding light output from the LEDs and detected by the plurality of photosensors, each of the photosensors sending a light output feedback signal for the control of the optical output from the LEDs and via pulse modulation based on the feedback from at least one of the photosensors mounted among the LEDs;

b) the microcontroller receives the feedback from the at least one of the photosensors and uses the feedback to control the quantity of the current that is sent to the LEDs via the pulse modulation;

c) the array of LEDs is mounted on a surface of an insulated metal substrate material;

d) the array of LEDs uses infrared wavelengths that are not substantially visible to a human eye but are visible to IR-sensitive CCD and CMOS cameras;

e) the LEDs are compacted closely together and use one or more lenses to emit light therefrom;

f) the photosensors are mounted among the LEDs and provide feedback enabling the photodetector circuit to obtain substantially average measurement values of the light output from the LEDs; and g) the microcontroller determines maximum allowable electrical current to be supplied by the drive control circuit for the LEDs.

7. The constant optical output illuminator system of claim 6, in which:

a) each of the plurality of photosensors includes a bandpass filter that filters out light having wavelengths outside a range of intended light output wavelength of the LEDs; and b) the photosensors are oriented toward the LEDs within the LED array so as to capture light from the LEDs rather than external ambient light.

8. The constant optical output illuminator system of claim 1, wherein the at least one photosensor comprises a plurality of photosensors, and optical output from the LEDs is controlled by the drive control circuit based on its receiving feedback regarding light output from the LEDs and detected by at least one of the photosensors which are mounted among the LEDs.

9. The constant optical output illuminator system of claim 1, wherein the at least one photosensor comprises a plurality of photosensors, which are mounted among the LEDs, each photosensor detecting light output from the LEDs and sending a light output feedback signal regarding the light output from the LEDs to the drive control circuit for controlling of the optical output from the LEDs.

10. The constant optical output illuminator system of claim 1, in which the optical output from the LEDs is controlled via pulse modulation based on feedback to the drive control circuit from the at least one photosensor mounted among the LEDs regarding light output from the LEDs and detected by the at least one photosensor.

11. The constant optical output illuminator system of claim 1, further comprising a microcontroller that receives feedback from the at least one photosensor in the photodetector circuit regarding light output from the LEDs and detected by the at least one photosensor and uses that feedback to control a quantity of electrical current that is sent to the LEDs via pulse modulation.

12. The constant optical output illuminator system of claim 1, in which the array of LEDs is mounted on a surface of an insulated metal substrate material.

13. The constant optical output illuminator system of claim 1, in which the array of LEDs uses infrared wavelengths that are not substantially visible to a human eye but are visible to IR-sensitive CCD and CMOS cameras.

14. The constant optical output illuminator system of claim 1, in which the LEDs are compacted closely together and use one or more lenses to emit light therefrom.

15. The constant optical output illuminator system of claim 14, in which one or more of the lenses are tessellated hexagonal lenses.

16. The constant optical output illuminator system of claim 1, wherein the at least one photosensor comprises a plurality of photosensors, and the photodetector circuit comprises the plurality of photosensors, and each photosensor includes a bandpass filter that filters out light having wavelengths outside a range of intended light output wavelength of the LEDs in the photodetector circuit.

17. The constant optical output illuminator system of claim 1, in which a microcontroller determines maximum allowable electrical current to be supplied by the drive control circuit to the LEDs.

18. The constant optical output illuminator system of claim 1, in which a microcontroller monitors temperature at a junction of an LED and the LED power supply circuitry and ensures the temperature does not exceed a predetermined maximum level.

19. The constant optical output illuminator system of claim 1, in which a microcontroller triggers an alarm upon determining that the LEDs' ability to emit light decays beyond a predetermined level.

20. The constant optical output illuminator system of claim 1, in which the output feedback and compensation circuitry adjusts optical output from the LEDs to compensate for the optical output from the LEDs varying with ambient temperature, with system temperature, and with aging of the LEDs.

21. The constant optical output illuminator system of claim 1, wherein the at least one photosensor comprises a plurality of photosensors, and optical output from the LEDs is controlled based on feedback from at least one of the photosensors that is mounted among the LEDs regarding light output from the LEDs and detected by the at least one photosensor.

22. The constant optical output illuminator system of claim 21, in which a) optical output from the LEDs is controlled by the output feedback and compensation circuitry via a quantity of electrical current that is sent to the LEDs based on feedback from the plurality of photosensors mounted among the LEDs regarding light output from the LEDs and detected by the plurality of photosensors, each photosensor sending a light output feedback signal for the control of the optical output from the LEDs and via pulse modulation based on the feedback from at least one of the photosensors mounted among the array of LEDs;

b) a microcontroller receives the feedback from the photosensors and uses the feedback to control the quantity of the current that is sent to the LEDs via the pulse modulation; and c) the photosensors are mounted among the LEDs and provide feedback enabling the photodetector circuit to obtain substantially average measurement values of the light output from the LEDs.

23. The constant optical output illuminator system of claim 21, in which:

a) the array of LEDs is mounted on a surface of an insulated metal substrate material;

b) the array of LEDs uses infrared wavelengths that are not substantially visible to a human eye but are visible to IR-sensitive CCD and CMOS cameras;

c) the LEDs are compacted closely together and use one or more lenses to emit light therefrom, d) the plurality of photosensors are mounted among the LEDs and provide the feedback enabling the photodetector circuit to obtain substantially average measurement values of the light output from the LEDs; and e) a microcontroller determines maximum allowable electrical current to be supplied by the drive control circuit to the LEDs.

24. The constant optical output illuminator system of claim 21, in which:

a) each of the photosensors includes a bandpass filter and the bandpass filter filters out light having wavelengths outside a range of intended light output wavelength of the LEDs; and b) the photosensors are oriented within the LED array so as to capture light from the LEDs rather than external ambient light.

25. A constant optical output illuminator system to enable reliable, long-duration, low-light imaging and data capture for surveillance and security applications, comprising an array of LEDs, LED power supply circuitry, and output feedback and compensation circuitry, in which:

a) a photodetector circuit provides a voltage signal proportional to an amount of light falling on a photosensor and the voltage signal is fed to a drive control circuit for controlling electrical current that is provided to the LEDs, to achieve a desired optical output as measured by a voltage setpoint of the photosensor across the photodetector circuit;

b) the voltage setpoint is adjustable via a microcontroller;

c) optical output from the LEDs is controlled by the output feedback and compensation circuitry via a quantity of electrical current that is sent to the LEDs based on feedback from a plurality of the photosensors mounted among the LEDs regarding light output from the LEDs and detected by the plurality of photosensors, each of the photosensors sending a light output feedback signal for the control of the optical output from the LEDs and via pulse modulation based on the feedback from at least one of the photosensors mounted among the LEDs;

d) the microcontroller receives the feedback from the photosensors and uses the feedback to control a quantity of the current that is sent to the LEDs via the pulse modulation;

e) the array of LEDs is mounted on a surface of an insulated metal substrate material;

f) the array of LEDs uses infrared wavelengths that are not substantially visible to a human eye but are visible to IR-sensitive CCD and CMOS cameras;

g) the LEDs are compacted closely together and use one or more lenses to emit light therefrom;

h) the photosensors are mounted among the LEDs and provide the feedback enabling the photodetector circuit to obtain substantially average measurement values of the light output from the LEDs;

i) the microcontroller determines maximum allowable electrical current to be supplied by the drive control circuit to the LEDs;

j) the microcontroller monitors temperature at a junction of an LED and the LED power supply circuitry and ensures the temperature does not exceed a predetermined maximum level;

k) the microcontroller triggers an alarm upon determining when the LEDs' ability to emit light decays beyond a predetermined level;

l) the output feedback and compensation circuitry adjusts the optical output from the LEDs to compensate for the optical output from the LEDs varying with ambient temperature, with system temperature, and with aging of the LEDs; and m) the drive control circuit compensates for input voltage variations, temperature which affects both the drive control circuit and the optical output, component tolerances in the drive circuit, and performance degradation of the power components and LEDs.

26. A constant optical output illuminator system to enable reliable, long-duration, low-light imaging and data capture for surveillance and security applications, comprising an array of LEDs, LED power supply circuitry, and output feedback and compensation circuitry, in which:

a) optical output from the LEDs is controlled based on feedback from at least one photosensor that is mounted among the LEDs regarding light output from the LEDs and detected by the at least one photosensor;

b) a microcontroller monitors temperature at a junction of an LED and the LED power supply circuitry and ensures the temperature does not exceed a predetermined maximum level;

c) the microcontroller triggers an alarm upon determining that the LEDs' ability to emit light decays beyond a predetermined level;

d) the output feedback and compensation circuitry adjusts the optical output from the LEDs to compensate for the optical output from the LEDs varying with ambient temperature, with system temperature, and with aging of the LEDs; and e) a drive control circuit compensates for input voltage variations from the LED power supply circuitry, temperature which affects both the control circuitry and the optical output, component tolerances in a drive circuit, and performance degradation of the LEDs.

* * * * *

UNITED STATES PATENT AND TRADEMARK OFFICE

CERTIFICATE OF CORRECTION

PATENT NO. : 8,692,669 B2
APPLICATION NO. : 12/600272
DATED : April 8, 2014
INVENTOR(S) : Mayer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1047 days.

Signed and Sealed this
Twenty-ninth Day of September, 2015

Michelle K. Lee

Michelle K. Lee
*Director of the United States Patent and Trademark Office*